US011058908B2

(12) United States Patent
McCann

(10) Patent No.: US 11,058,908 B2
(45) Date of Patent: Jul. 13, 2021

(54) WEIGHT TRAINING APPARATUS

(71) Applicant: David McCann, Waterford, MI (US)

(72) Inventor: David McCann, Waterford, MI (US)

( * ) Notice: Subject to any disclaimer, the term of this patent is extended or adjusted under 35 U.S.C. 154(b) by 0 days.

(21) Appl. No.: 16/935,752

(22) Filed: Jul. 22, 2020

(65) Prior Publication Data

US 2020/0353301 A1 Nov. 12, 2020

(51) Int. Cl.

| | |
|---|---|
| ***A63B 21/008*** | (2006.01) |
| ***A63B 21/00*** | (2006.01) |
| ***A63B 71/06*** | (2006.01) |
| ***F04B 49/06*** | (2006.01) |
| ***F01B 3/00*** | (2006.01) |
| ***A63B 22/06*** | (2006.01) |
| ***A63B 22/00*** | (2006.01) |
| ***A63B 23/04*** | (2006.01) |
| ***A63B 23/12*** | (2006.01) |

(Continued)

(52) U.S. Cl.

CPC .... *A63B 21/0087* (2013.01); *A63B 21/00069* (2013.01); *A63B 21/4035* (2015.10); *A63B 71/0619* (2013.01); *F01B 3/00* (2013.01); *F04B 49/06* (2013.01); *A63B 21/078* (2013.01); *A63B 22/0076* (2013.01); *A63B 22/02* (2013.01); *A63B 22/04* (2013.01); *A63B 22/0605* (2013.01); *A63B 22/0664* (2013.01); *A63B 23/0494* (2013.01); *A63B 23/1245* (2013.01); *A63B 23/1281* (2013.01); *A63B 2023/0411* (2013.01); *A63B 2225/102* (2013.01)

(58) Field of Classification Search

CPC ..... A63B 21/00058; A63B 21/00069; A63B 21/00076; A63B 21/00178; A63B 21/00181; A63B 21/008; A63B 21/0083; A63B 21/0085; A63B 21/0087; A63B 21/072; A63B 21/0724; A63B 21/078; A63B 21/4027; A63B 21/4033; A63B 21/4035; A63B 21/4045; A63B 23/04; A63B 23/0405; A63B 23/0482; A63B 23/0494; A63B 23/12; A63B 23/1209; A63B 23/1245; A63B 23/1281; A63B 2023/0411; A63B 71/0054; A63B 2071/0063; A63B 2071/0072; A63B 2071/0081; A63B 2071/009; A63B 2244/09

See application file for complete search history.

(56) References Cited

U.S. PATENT DOCUMENTS 3,369,403 A * 2/1968 Carlin ..... A63B 21/0083 482/113
4,063,726 A * 12/1977 Wilson ..... A63B 21/00178 482/5

(Continued)

FOREIGN PATENT DOCUMENTS

| | | | |
|---|---|---|---|
| JP | 2015163108 | A | 9/2015 |
| KR | 20190118885 | A | 10/2019 |
| WO | 2016135499 | A1 | 1/2016 |

*Primary Examiner* — Gary D Urbiel Goldner
(74) *Attorney, Agent, or Firm* — Brooks Kushman P.C.

(57) ABSTRACT

A weight training apparatus using hydraulics or pneumatics for applying positive and negative resistance closer to a user's maximum capacity throughout a lift is provided. The weight training apparatus allows for weight training without weights. The weight training apparatus may provide a more effective and safer mechanism for training than conventional techniques.

24 Claims, 6 Drawing Sheets

(51) Int. Cl.
*A63B 21/078* (2006.01)
*A63B 22/02* (2006.01)
*A63B 22/04* (2006.01)

(56) References Cited

U.S. PATENT DOCUMENTS 4,544,154 A * 10/1985 Ariel ..... A63B 24/00 417/545
4,846,466 A * 7/1989 Stima, III ..... A63B 23/03516 482/112
4,869,498 A * 9/1989 Wolf ..... A63B 21/0083 482/113
5,064,193 A * 11/1991 Sainte ..... A63B 21/00072 482/113
5,100,127 A * 3/1992 Melnick ..... A01K 15/027 119/700
5,209,714 A * 5/1993 Sainte ..... A63B 21/0083 482/113
5,254,066 A * 10/1993 Brown ..... A63B 21/154 482/113
5,362,298 A * 11/1994 Brown ..... A63B 21/154 482/113
5,653,666 A * 8/1997 Pantoleon ..... A63B 21/078 482/108
6,413,195 B1 * 7/2002 Barzelay ..... A63B 21/00178 482/112
2002/0072452 A1 * 6/2002 Torkelson ..... A63B 23/0429 482/51
2007/0259759 A1 * 11/2007 Sumners ..... A63B 21/0087 482/92
2007/0287612 A1 * 12/2007 Cha ..... A63B 21/00069 482/111
2010/0311552 A1 * 12/2010 Sumners ..... A63B 21/0087 482/111

* cited by examiner

WEIGHT TRAINING APPARATUS

TECHNICAL FIELD

In at least one aspect, the present invention relates to a weight training apparatus for fitness and physical therapy, and methods of using the weight training apparatus.

BACKGROUND

Weight training is a helpful activity for both ordinary people and paid athletes to develop strength and increase the size of skeletal muscles. Routine weight training may provide health benefits and help an individual obtain a desired physique. Further, weight training can be used to improve athletic performance. Many competitive athletes utilize weight training to acquire a competitive edge. Weightlifting as a form of weight training has become a competition itself and is presented in the Olympics. Weight training conventionally relies on moving mass under the force of gravity. Muscle development is obtained by contraction and extension of muscles under the resistance of weight. In general, the greater the weight, the greater the gains in muscle development.

Generally, free weights and compound lifts are considered superior to isolated lifts and machine exercises because they utilize larger muscle groups and recruit stabilizing muscles. Both free weights and machines generally rely on weights. However, conventional lifts suffer from a disadvantage that the maximum weight used is determined by the weakest point of the lift. In other words, only the weakest muscle or muscle group in the lift is exercised at its full capacity. For example, in a bench press, most individuals are weakest when the bar is within a few inches of their chest. This means that the maximum weight individuals can use is what they can lift off their chest despite the fact that they could lift significantly more at other points of the weight training exercise. Many techniques have been utilized to offset this disadvantage, including using chains, elastic bands, half reps, isolated exercises, or spotters. Long chains increase the weight the further a bar is lifted from the floor therefore increasing the weight at the top of the exercise. Similarly, bands provide greater resistance the further they are extended and therefore provide greater resistance at the peak of a lift. However, chains and bands can also be more dangerous for a weightlifter. Many lifts require the weightlifter to successful complete the entire lift before they can safely offload or rack the weights. Neither chains nor bands ensure a weightlifter is working at their full capacity throughout the lift. Half reps may be used to supplement a lift but fail to achieve full extension or full contraction of the muscles which is also considered important for muscle development. Isolated exercises focus on more limited muscles or muscle groups and usually can only be accomplished with lower loads or weight. Isolated lifts also may lead to disproportionate muscle development as minor muscle groups such as stabilizing muscles may be overlooked or under-utilized. Further, isolated exercises may provide less of a competitive advantage because competitive sports usually require compound movements. Finally, spotters require the help of others which can be uncomfortable, inconvenient, more time consuming, or expensive. Accordingly, despite these measures there is still a need for improvement.

Muscle development relies on two forms of resistance, positive resistance and negative resistance. Both are considered important to muscle development. Positive resistance occurs during concentric phase of a lift and involves shortening of the intended muscle or muscle group. Whereas, negative resistance occurs during the eccentric phase of a lift and involves extension of the intended muscle or muscle group. Often weight training is limited by the concentric phase because an individual can tolerate much greater resistance during the eccentric phase. Overcoming this limitation can be difficult because changing weights in the middle of a lift can be inefficient or impossible. Usually, both the concentric and eccentric phases are desirable and considered beneficial to muscle development. Accordingly, the maximum potential returns from eccentric phase are often forfeited or overlooked.

Health, athletic performance, and physique can also be improved through aerobic exercises or cardio. Aerobic exercise involves enhancing the body's ability to transport nutrients such as oxygen needed for providing energy to the body's cells over a longer time period. Often aerobic exercise techniques involve traveling large distances. For example, walking, running, and cycling require travelling. However, there is often a desire to stay in a controlled environment such as a home or gym. Accordingly, equipment such as treadmills and stationary bikes have been used. However, such equipment has been criticized as not being comparable to the real exercise of walking, jogging or cycling. Further, walking, running, or cycling for any length of time may be difficult for some individuals.

Due to the significant benefits of exercise and its widespread adoption, great effort has been afforded to improve efficiency, convenience, and results associated with exercising. Great effort has also been employed in rehabilitating injured or ill individuals through exercise and physical therapy. Yet, physical therapy can still benefit from improvements. Accordingly, there is a need for weight training equipment and methods to improved training, rehabilitation capabilities, or to offer alternatives to current techniques.

SUMMARY

In one embodiment, a weight training apparatus including a pump in fluid communication with a housing which is at least partially occupied by a piston having a linkage for communication with a user. The pump may be configured to be driven by a rotational force and the rotational force may be supplied by a motor. The pump may define a pump inlet and a pump outlet. The housing may define a longitudinal axis and the piston may be capable of moving in a first direction and second direction along the longitudinal axis from a first position to a second position. The weight training apparatus may further include a reservoir having a reservoir inlet and a reservoir outlet. In one variation, the reservoir outlet is in fluid communication with the pump inlet, the pump outlet is in fluid communication with the internal cavity, and the internal cavity is in fluid communication with the reservoir inlet forming a fluid pathway. In a refinement, the piston includes a piston shaft and a piston head having a first piston surface and a second piston surface opposite the first piston surface. The piston head may separate a blind end of the internal cavity and a head end of the internal cavity. The blind end being distal to the piston shaft and the head end being proximal to the piston shaft. In one embodiment, the fluid pathway is configurable to inhibit movement of the piston in the first direction along the longitudinal axis at a first pressure when a user force is applied through the linkage and the fluid pathway is configurable to apply a second fluid pressure to move the piston in the second direction along the longitudinal axis.

In another embodiment, the fluid pathway is configurable to inhibit movement of the piston in the second direction at a third fluid pressure when a user force is applied to the linkage and the fluid pathway may be configured to apply a fourth fluid pressure to the second piston surface to move the piston in the first direction.

In one embodiment a method for weight training is provided. The method may include restricting a first fluid flow from an internal cavity defined by a housing that is at least partially occupied by a piston to inhibit movement of the piston in a first direction along a longitudinal axis defined by the housing when the piston is experiencing a user force in the first direction and applying a first fluid pressure to the piston to move the piston in the second direction along the longitudinal axis.

In still another embodiment, an aerobic apparatus is provided. The aerobic apparatus may include a variable axial piston pump in fluid communication with a fluid motor, which is in mechanical communication with a linkage. At least a portion of the linkage may rotate. The variable axial piston pump includes a swash plate and is configured to be driven by a first rotational force, which may be provided by a motor. In a variation, the fluid motor may include a rotatable component for mechanical communication with the linkage. The fluid motor may include a first aperture and a second aperture both in fluid communication with the variable axial piston pump by a fluid loop. The variable axial piston pump is configurable to apply a first fluid pressure in the first aperture and the fluid motor is configured to provide a rotational force in a first direction in response to the first fluid pressure. In a refinement, the variable axial piston pump is configurable to apply a second fluid pressure in the second aperture and the fluid motor is configured to provide a rotational force in the second direction opposite the first direction in response to the second fluid pressure. The rotational force provided by the fluid motor may provide assistance to a user applying a force in the same direction or may assist in providing mobility to a user applying no force.

DETAILED DESCRIPTION

Figure 1:
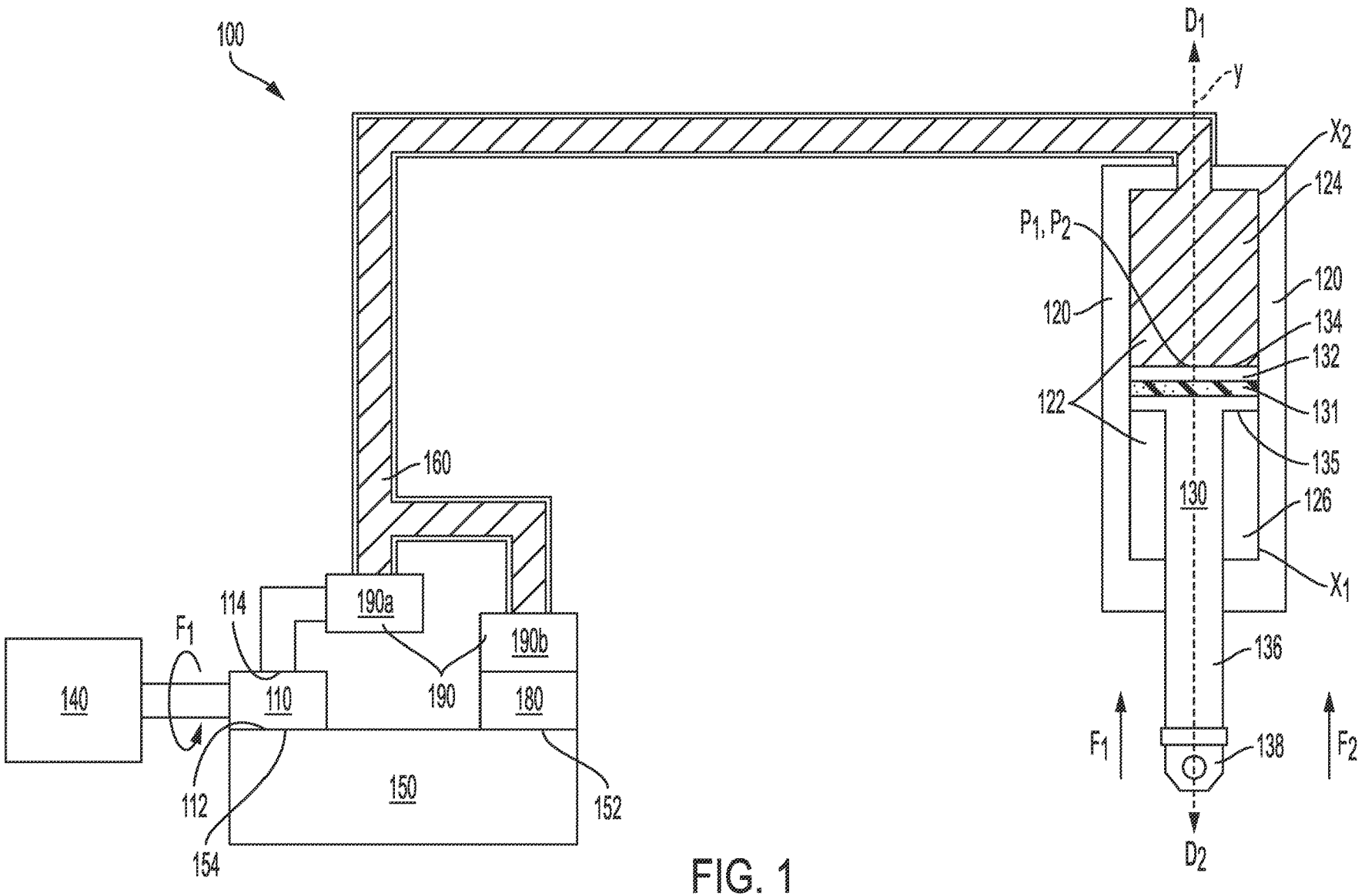
FIG. 1 is a schematic view of a weight training apparatus according to one embodiment.

Reference will now be made in detail to presently preferred embodiments and methods of the present invention, which constitute the best modes of practicing the invention presently known to the inventor. The figures are not necessarily to scale. However, it is to be understood that the disclosed embodiments are merely exemplary of the invention that may be embodied in various and alternative forms. Therefore, specific details disclosed herein are not to be interpreted as limiting, but merely as a representative basis for any aspect of the invention and/or as a representative basis for teaching one skilled in the art to variously employ the present invention.

Except in the examples, or where otherwise expressly indicated, all numerical quantities in this description indicating amounts are to be understood as modified by the word "about" in describing the broadest scope of the invention. Practice within the numerical limits stated is generally preferred. Also, unless expressly stated to the contrary: percent, "parts of," and ratio values are by weight. The description of a group or class as suitable or preferred for a given purpose in connection with the invention implies that mixtures of any two or more of the members of the group or class are equally suitable or preferred. The first definition of an acronym or other abbreviation applies to all subsequent uses herein of the same abbreviation and applies mutatis mutandis to normal grammatical variations of the initially defined abbreviation. Unless expressly stated to the contrary, measurement of a property is determined by the same technique as previously or later referenced for the same property.

It must also be noted that, as used in the specification and the appended claims, the singular form "a," "an," and "the" comprise plural referents unless the context clearly indicates otherwise. For example, reference to a component in the singular is intended to comprise a plurality of components.

The phrase "composed of" means "including" or "comprising." Typically, this phrase is used to denote that an object is formed from a material.

The term "comprising" is synonymous with "including," "having," "containing," or "characterized by." These terms are inclusive and open-ended and do not exclude additional, unrecited elements or method steps.

The phrase "consisting of" excludes any element, step, or ingredient not specified in the claim. When this phrase appears in a clause of the body of a claim, rather than immediately following the preamble, it limits only the element set forth in that clause; other elements are not excluded from the claim as a whole.

The phrase "consisting essentially of" limits the scope of a claim to the specified materials or steps, plus those that do not materially affect the basic and novel characteristic(s) of the claimed subject matter.

With respect to the terms "comprising," "consisting of," and "consisting essentially of," where one of these three terms is used herein, the presently disclosed and claimed subject matter can include the use of either of the other two terms.

The term "substantially," "generally," or "about" may be used herein to describe disclosed or claimed embodiments. The term "substantially" may modify a value or relative characteristic disclosed or claimed in the present disclosure. In such instances, "substantially" may signify that the value or relative characteristic it modifies is within ±0%, 0.1%, 0.5%, 1%, 2%, 3%, 4%, 5% or 10% of the value or relative characteristic.

It should also be appreciated that integer ranges explicitly include all intervening integers. For example, the integer range 1-10 explicitly includes 1, 2, 3, 4, 5, 6, 7, 8, 9, and 10. Similarly, the range 1 to 100 includes 1, 2, 3, 4 . . . 97, 98, 99, 100. Similarly, when any range is called for, intervening numbers that are increments of the difference between the upper limit and the lower limit divided by 10 can be taken as alternative upper or lower limits. For example, if the range is 1.1. to 2.1 the following numbers 1.2, 1.3, 1.4, 1.5, 1.6, 1.7, 1.8, 1.9, and 2.0 can be selected as lower or upper limits.

Throughout this application, where publications are referenced, the disclosures of these publications in their entireties are hereby incorporated by reference into this application to more fully describe the state of the art to which this invention pertains.

Referring to FIG. 1, a schematic view depicting a weight training apparatus is provided. Weight training apparatus 100 includes pump 110 and housing 120 defining internal cavity 122, which is at least partially occupied by piston 130. Pump 110 is in fluid communication with internal cavity 122. Weight training apparatus 100 may also include a mechanism configured to generate mechanical energy, such as motor 140 configured to drive pump 110. Weight training apparatus 100 may further include reservoir 150 configured to temporarily store fluid 160. Reservoir 150 is in fluid communication with pump 110 and internal cavity 122.

In one or more embodiments, pump 110 may be any suitable pump for moving fluid 160. For example, pump 110 may be but is not limited to a positive displacement pump, an impulse pump, a velocity pump, a gravity pump, a steam pump, a centrifugal pump, a diaphragm pump, a gear pump, a rotary vane pump, a variable axial piston pump, a radial pump, a peristaltic pump, a lobe pump, a piston pump, or a compressor. In one variation, pump 110 may be suitable for a hydraulic system. In another refinement, pump 110 may be suitable for a pneumatic system. In still another refinement, pump 110 may be powered by rotational force $F_1$.

In an embodiment, housing 120 and piston 130 may be referred to as a cylinder. However, housing 120 and piston 130 are not limited to the geometric shape of a cylinder. Housing 120 may be any suitable shape and size. Housing 120 defines internal cavity 122 that is at least partially occupied by piston 130. Piston 130 is configured to move within housing 120. In at least one variation, housing 120 defines a longitudinal axis Y and piston 130 is configured to move in first direction $D_1$ and second direction $D_2$ along longitudinal axis Y. In at least one refinement, piston 130 moves from first position $X_1$ to second position $X_2$ and/or from second position $X_2$ to first position $X_1$. In yet another refinement, piston 130 and/or housing 120 includes one or more seals 131. Piston 130 may be of any suitable shape and size. In at least one variation, piston 130 includes piston head 132 having first piston surface 134, piston shaft 136, and linkage 138. In at least one refinement, linkage 138 is configured for communication with a user. For example, linkage 138 may be but is not limited to a handle, a peddle or a platform. In at least one variation, linkage 138 resembles a barbell. In some variations, piston head 132 includes second piston surface 135 opposite first piston surface 134. In at least one variation, piston head 132 separates internal cavity 122 into blind end 124 and head end 126. In a refinement, blind end 124 is distal to piston shaft 136, and head end 126 is proximal to piston shaft 136. In at least one variation, housing 120 and piston 130 may be referred to as a single action cylinder, as depicted in FIG. 1. However, housing 120 and piston 130 are not limited to the single action cylinder configuration.

In one variation, motor 140 is configured to power pump 110. For example, motor 140 may be but is not limited to an electric motor, a combustion motor, or a steam motor. In at least one refinement, motor 140 is configured to create rotational force $F_1$ for driving pump 110 and pump 110 is configured to be driven by rotational force $F_1$. In an embodiment, pump 110 includes pump inlet 112 and pump outlet 114. In at least one variation, fluid 160 is received through pump inlet 112 and fluid 160 is pumped out of pump outlet 114.

In one or more embodiments, reservoir 150 is configured to temporarily store excess fluid 160. Reservoir 150 may be any suitable shape and size. In at least one variation, reservoir 150 is in fluid communication with the pump 110 and internal cavity 122. In a refinement, reservoir 150 includes reservoir inlet 152 and reservoir outlet 154. In one variation, reservoir inlet 152 is in fluid communication with internal cavity 122 and reservoir outlet 154 is in fluid communication with pump inlet 112. In one variation, reservoir 150 may facilitate cooling of fluid 160. In a pneumatic system, pump 110 may pull air directly from the ambient environment or from reservoir 150. In a refinement, reservoir 150 defines a compartment for storing fluid 160. In some variations of a pneumatic system, reservoir 150 includes a fluid release for releasing air into the ambient environment. In a pneumatic refinement, reservoir 150 may be the ambient environment. Any suitable fluid, such as a liquid or a gas, may be used. For example, in a hydraulic system, fluid 160 may be but is not limited to hydraulic oils or water. Similarly, in a pneumatic system, fluid 160 may be but is not limited to ambient air or any inert gas.

In one or more embodiments, weight training apparatus 100 may be configured to a first positive resistance mode for applying a positive resistance to a user and a negative resistance mode for applying a negative resistance to a user. In one variation, the positive resistance mode restricts a first fluid flow from pump 110 to internal cavity 122 and permits a second fluid flow from internal cavity 122 to reservoir 150. Similarly, the negative resistance mode permits the first fluid flow from pump 110 to internal cavity 122 and restricts the second fluid flow from internal cavity 122 to reservoir 150.

In at least one embodiment, any two components in fluid communication may be connected by a fluid pathway having one or more walls. The walls may be formed from any suitable material. In at least one variation, a fluid pathway may be a high-pressure hose. In another variation, the fluid pathway may be a hard, solid tubing. In a refinement, any two components in fluid communication may also be directly connected. Weight training apparatus 100 may further include one or more valves 190 for configuring weight training apparatus 100 as described above. One or more valves 190 may be individually opened or closed for facilitating movement of fluid 160 to or from the internal cavity 122. In a refinement, the one or more valves 190 may include first valve **190*a* and second valve 190*b***. As described herein and in one or more embodiments, any two components are considered in fluid communication when connected by a fluid pathway even if temporarily blocked, for example, by a valve.

Figure 2:
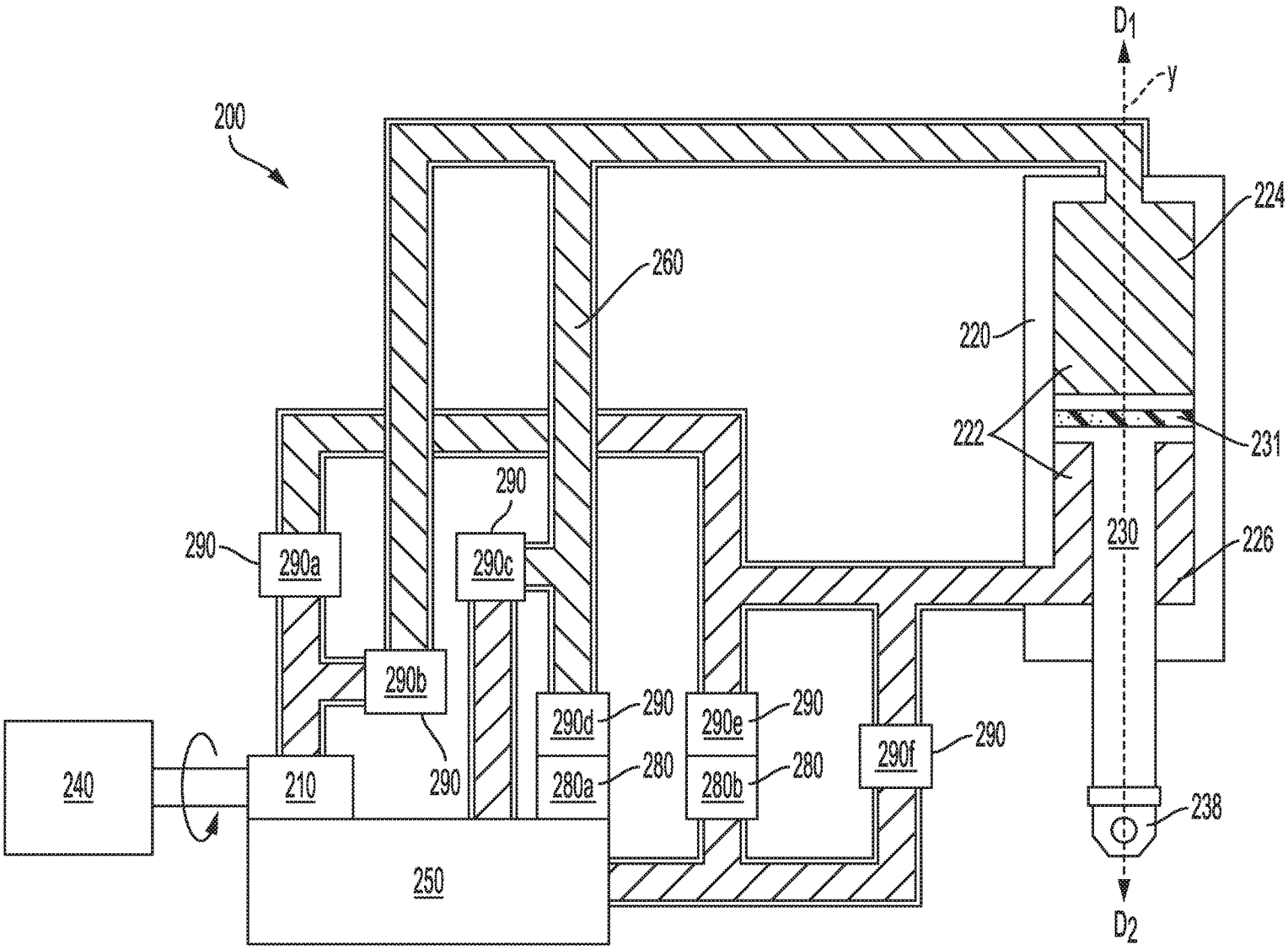
FIG. 2 is a schematic view of a weight training apparatus according to another embodiment.

Referring again to FIG. 1, one variation for applying a positive resistance to a user who is working out is described. To apply a positive resistance, first valve **190*a* may be at least partially restricted or closed and second valve 190*b* may be at least partially open allowing movement of the piston 130 in the first direction $D_1$ against a resistance. The resistance may be the result of first pressure $P_1$. In at least one variation, the first pressure $P_1$ may be applied to the first piston surface. The first pressure $P_1$ is created by a fluid 160 in the internal cavity 122. The first pressure $P_1$ is created when a user applies a first user force $F_1$ through the linkage 138. The configuration of the housing 120 or the fluid communication between the internal cavity 122 and the reservoir 150 may contribute to providing the first pressure $P_1$ when a user applies the first user force $F_1$. For example, pressure is increased as a fluid passes through a narrowing passage (i.e. Bernoulli's principle). The static friction and friction generated by a moving fluid will also contribute to resistance. If the first user force $F_1$ is enough to overcome the friction, piston 130 moves in the first direction $D_1$. In a refinement, the first user force $F_1$ is applied through the linkage 138, thus the linkage 138 experiences resistance and its movement is inhibited. The speed of the piston 130 in the first direction $D_1$ is variable or depends on the amount of force the user applies. The more force the user applies the faster the piston moves and the faster fluid 160 is discharged from the internal cavity 122. In still another refinement, flow controller 180 may be between internal cavity 122 and fluid reservoir 150. Flow controller 180 controls the second fluid flow from internal cavity 122 to reservoir 150. Flow controller 180 may be adjusted to allow or restrict the second fluid flow thus adjusting the speed of piston 130 in the first direction $D_1$ when first user force $F_1$ is applied. In at least one embodiment, valve 190***b* and flow controller 180 may be a single unit. Apparatus 100 is not limited to two valves or a single flow controller. Alternatively, FIG. 2 depicts apparatus 200 including one or more valves 290 and a plurality of flow controllers 280, wherein the one or more valves 290 includes six valves. In one or more embodiments, the valves are not limited to being configured as separate units. For example, in FIG. 1, valve 190*a* and valve 190*b* may be a single unit such as a 3-way valve.

The one or more valves 190 may also be configured to provide a negative resistance to a user who is working out. To apply a negative resistance, first valve 190*a* may be at least partially open and second valve 190*b* may be restricted or closed allowing fluid to be pumped from the pump 110 to the internal cavity 122. Pump 110 may pump fluid into the internal cavity 122 until piston 130 moves in the second direction $D_2$ from second fluid pressure $P_2$. Piston 130 may move even against a user applying a user force in the first direction $D_1$ opposite the second direction $D_2$. If a user applies a second user force $F_2$ in the first direction $D_1$ the user will experience negative resistance as piston 130 moves in the second direction $D_2$ against the second user force $F_2$.

In an embodiment, weight training apparatus 100 may further include a first switch configured to engage the first positive resistance mode and the first negative resistance mode. In a variation, the apparatus 100 includes one or more sensors for triggering the first switch automatically when piston 130 is in first position $X_1$ or second position $X_2$. For example, when piston 130 is in first position $X_1$ the switch may be triggered to engage the positive resistance mode and when piston 130 is in second position $X_2$ the switch may be triggered to engage the negative resistance mode. In a refinement, apparatus 100 includes a kill switch. For example, when the kill switch is engaged (i.e. operative mode), apparatus 100 permits the positive and/or negative resistance modes but when the kill switch is disengaged (i.e. inoperative mode), apparatus 100 may be inoperable and fluid 160 cannot be moved from the pump 110 to the internal cavity 122. In at least one embodiment, the linkage 138 may include a handle resembling a bar and the kill switch when disengaged may protrude from the bar. In at least one embodiment, when the protruding kill switch is pressed flush with the bar it may become engaged allowing a user to workout. In still another refinement including a flow controller, the flow controller may permit the maximum flow when the kill switch is engaged.

Referring to FIG. 2, a schematic view depicting another weight training apparatus is provided. Weight training apparatus 200 includes pump 210 and housing 220 defining internal cavity 222, which is at least partially occupied by piston 230. Pump 210 is in fluid communication with internal cavity 222. Weight training apparatus 200 may also include a mechanism configured to generate mechanical energy, such as motor 240 for driving pump 210. Weight training apparatus 200 may further include reservoir 250 for temporarily storing fluid 260. Reservoir 250 is in fluid communication with pump 210 and internal cavity 222. The housing 220 and piston 230 are configured to form what is known as a dual action cylinder. Housing 220 and piston 230 are not limited to the geometric shape of a cylinder and may be any suitable shape and size. In apparatus 200, pump 210 is in fluid communication with both blind end 224 and head end 226. Likewise, blind end 224 and head end 226 are in fluid communication with reservoir 250. Thus, the apparatus 200 may be configured to move piston 230 in both a first direction $D_1$ and a second direction $D_2$. Likewise, apparatus 200 may be configured to provide resistance when a user moves the piston in either the first $D_1$ or the second direction $D_2$. Piston 230 may be moved in either direction by pumping fluid 260 in either the blind end 224 or head end 226. In a variation, apparatus 200 may include a user control for selecting reverse mode. In reverse mode, apparatus 200 may be configured to provide a second positive resistance mode and a second negative resistance mode opposite the first positive resistance mode and the first negative resistance mode. In a refinement, apparatus 200 may include a first flow controller 280*a* between the blind end 224 and the reservoir 250 and a second flow controller 280*b* between the head end 226 and the reservoir 250. The flow controllers may be used to restrict fluid flow from the internal cavity 222 to the reservoir 250, which will restrict the speed a user can move the piston 230. Piston 230 may also be moved by suction from blind end 224 or head end 226 and is not limited to using positive pressure from fluid 160. In a refinement, suction may be used to move fluid 260. In still another refinement, suction may be used to ensure fluid remains in portions of the fluid pathway and/or internal cavity 222 throughout use.

Alternatively, a weight training apparatus may include two single action cylinders instead of a dual action cylinder. In still another variation, a weight training apparatus with a plurality of pumps in fluid communication with one or more housings may be used.

Conventionally, a bench press may be performed by a user lying on a bench where the barbell is removably mounted on hooks slightly less than arms-length away. The ends of the barbell are loaded with weights to provide a desired resistance. The user lifts the barbell from the hooks dismounting it by fully extending their arms and holding the weight directly above their chest. The user performs a repetition (otherwise known as a rep) by bending their arms to lower the barbell to their chest and then straightening their arms pushing the barbell away from their chest. The user typically performs one or more repetitions in sequence before remounting the barbell to complete a set. The user generally rests for a time period after a set before performing another set. The number of repetitions and sets vary by the type of training and desired end result. The amount of weight determines both the negative resistance and positive resistance applied during the exercise. This amount is fixed and the same for both negative and positive resistance. In this exercise, negative resistance is experienced as a user lowers the bar to their chest stretching the pectoral and tricep muscles. Positive resistance is experienced as a user raises the bar contracting the pectoral and tricep muscles. Both negative (e.g. stretching) and positive (e.g. contracting)

resistance is critical to muscle development. The amount of resistance or weight, in a conventional bench press, is limited to the amount of weight a user can lift from their chest to safely mount on the hooks. The amount of weight a user can safely lift from their chest is generally limited by their weakest point which is within a few inches of their chest. Accordingly, the rest of the exercise is performed at less than the maximum amount of resistance a user can tolerate. Several techniques to account for this deficiency exist, including hanging chains that are in contact with the floor on the ends of the barbell. Another technique includes mounting resistance bands to the ends of the barbell and near the floor. Both chains and resistance bands create the greatest resistance when the user's arms are extended and the least resistance when the bar is at the user's chest. Weightlifters also may perform what is known as half reps which involves lowering the bar approximately half-way to the user's chest before pushing it back up. Half-reps allow a user to increase the resistance by limiting the range of motion to avoid the weakest point.

Figure 3:
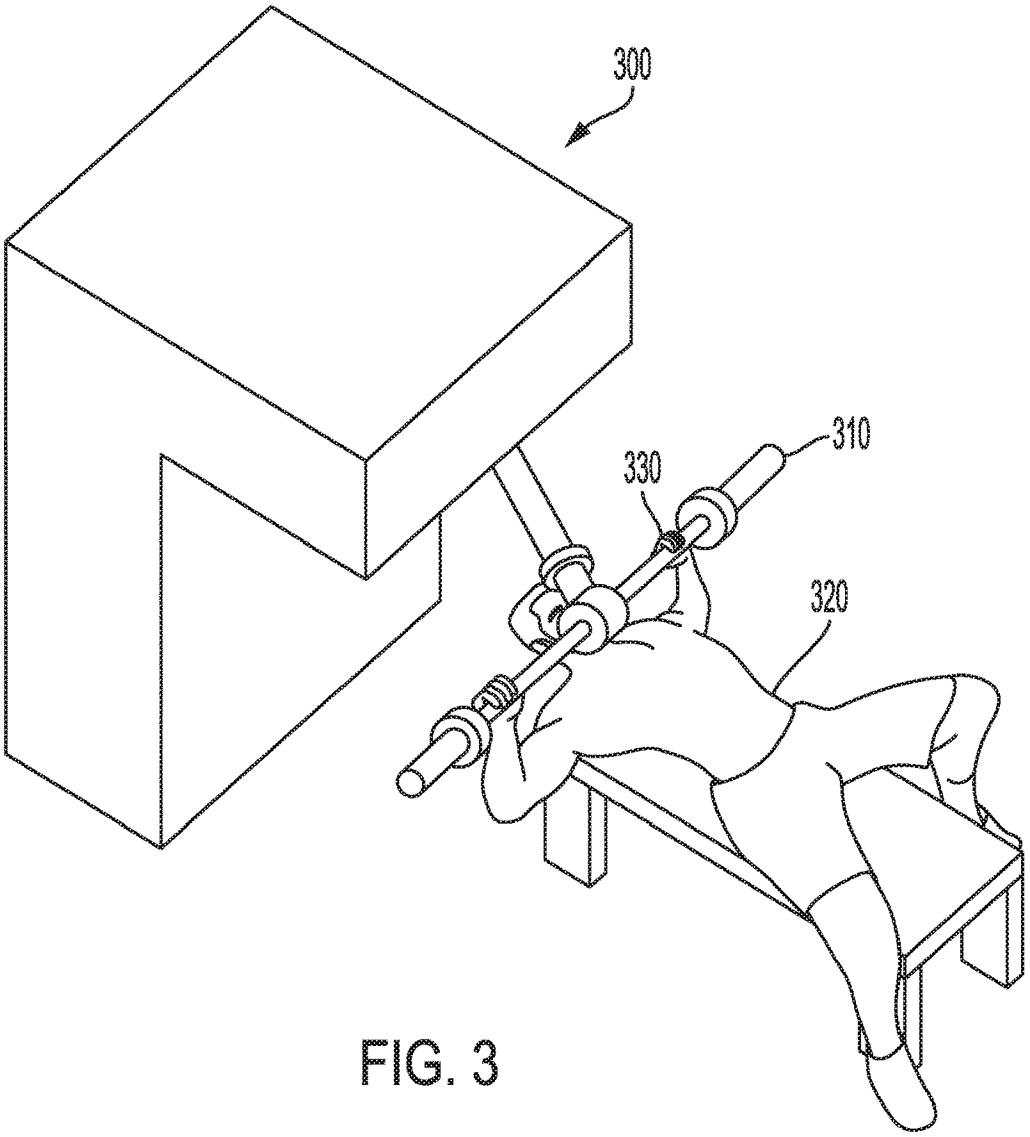
FIG. 3 is a schematic, perspective view of a weight training apparatus where a barbell is being used as a linkage to perform a bench press exercise.

In one embodiment, apparatus 300 includes linkage 310 resembling a barbell as depicted in FIG. 3. In such an embodiment, user 320 may perform a common weight training exercise known as the bench press. In one variation, apparatus 300 is configured such that the exercise starts at a start position and ends at an end position. Many exercises may have a plurality of positions including a start position, an end position and one or more intermediate positions. The apparatus may be configured to adjust any position of an exercise. For example, in the bench press, a bottom position and a top position exist. In a refinement, the start position and end position may be the same position. In still another refinement, the start position and end position may be different positions. In one example of the bench press, the start position may be at the user's chest. In another example, the start position may be where the user's arms are fully extended. In a refinement, the start position and/or end position may be adjustable to accommodate various users and exercises. Likewise, the bottom and top positions may be adjustable. For example, in the bench press, having an adjustable start position at a user's chest may be preferable. In the bench press example, user 320 lifts the bar from the start position while apparatus 300 is in the positive resistance mode to the top position. Then the apparatus 300 lowers the barbell, while in the negative resistance mode, from the top position to the user's chest.

While user 320 pushes the bar from their chest, user 320 may experience a range of resistance in a concentric phase (e.g. positive resistance). Likewise, user 320 may experience a range of resistance in an eccentric phase (e.g. negative resistance). The range may provide resistance closer to a user's maximum tolerable resistance through the entire repetition or movement as compared with conventional techniques. User 320 is not necessarily limited to the resistance at their weakest point. Further, the resistance experienced during the concentric and eccentric phases does not need to be the same. Apparatus 300 also accommodates user 320 as their muscles fatigue and their capacity to exert force or handle resistance decreases. There is no need to remove or add weight to adjust the load or resistance. Conventionally, a user must ensure that they have enough capacity to finish their last repetition and rack the weights. With conventional techniques, a user may be stuck under the weight if they fail to finish the repetition and properly rack the weight. But with apparatus 300 user 320 can stop a repetition at any point without racking the barbell. If multiple users are alternating use, there is also no need to add or remove weight. At most a user may adjust the flow controller to correspond to their strength or to regulate the speed at which he/she can move the linkage 310. In still another variation, the linkage 310 includes a kill switch 330 where the user grasps the linkage. In one refinement, the kill switch 330 is disengaged when the user releases the barbell. When the kill switch is disengaged the apparatus 300 stops. The apparatus 300 will not propel the linkage 310 while the kill switch is disengaged. In still another refinement, when the kill switch 330 is disengaged the flow controller allows the maximum flow and the bar is easily pushed away from the user's chest.

If apparatus 300 is a dual action cylinder as described in FIG. 2, other exercises may also be available. For example, if the bench and user are fixed to the ground, user 320 may experience negative resistance by pulling down on the bar while apparatus 300 moves the linkage 310 to the top position. User 320 may then experience positive resistance by pulling the barbell down from the top position to the user's chest. In this example, reverse mode may refer to a configuration that allows the user to experience positive and negative resistance as the user pulls the bar to his/her chest. In a variation, apparatus 300 includes a brace for fixing user 320 to the bench. In a refinement, the brace is a harness. For example, the harness may be positioned over the user's shoulders and resemble a harness commonly used on roller-coasters. Various different configurations for braces and harnesses may be suitable for different exercises.

Figure 4A:
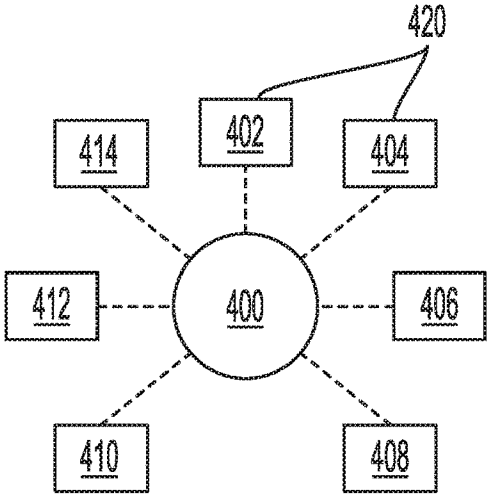
FIGS. 4A and 4B are diagrams depicting first and second modular weight training apparatuses.
Figure 4B:
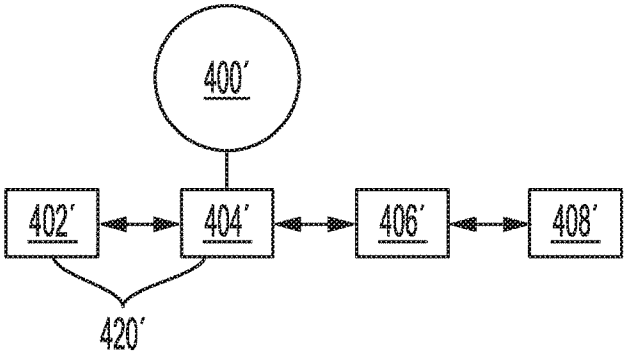

Referring to FIGS. 4A and 4B, a modular apparatus is provided. In FIG. 4A, modular apparatus 400 may be adjustable to attach to a plurality of machines 420 for different exercises. In one variation, the plurality of machines 420 may include a first machine 402, a second machine 404, a third machine 406, a fourth machine 408, a fifth machine 410, a sixth machine 412, and a seventh machine 414. In a refinement, first machine 402 may be a bench press and second machine 404 may be a squat machine. In still another refinement as depicted in FIG. 4B, a plurality of stations 420' may be available to accommodate different exercises with apparatus 400'. For example, the plurality of machines or stations may include but is not limited to a chest press machine, a peck deck fly machine, a lat pulldown machine, a leg press machine, a leg extension machine, a seated curl machine, a calf raise machine, a shoulder press machine, an incline press machine, seated row machine, a bench press machine, a power lift machine, military press machine, an abdominal crunch machine, a high row machine, a hack squat machine, a preacher curl machine, a squat machine or any combination thereof. In at least one example, station 402' may be a bench, as in FIG. 3 to accommodate a bench press exercise and station 404' may be a platform to accommodate a squat exercise.

Figure 5:
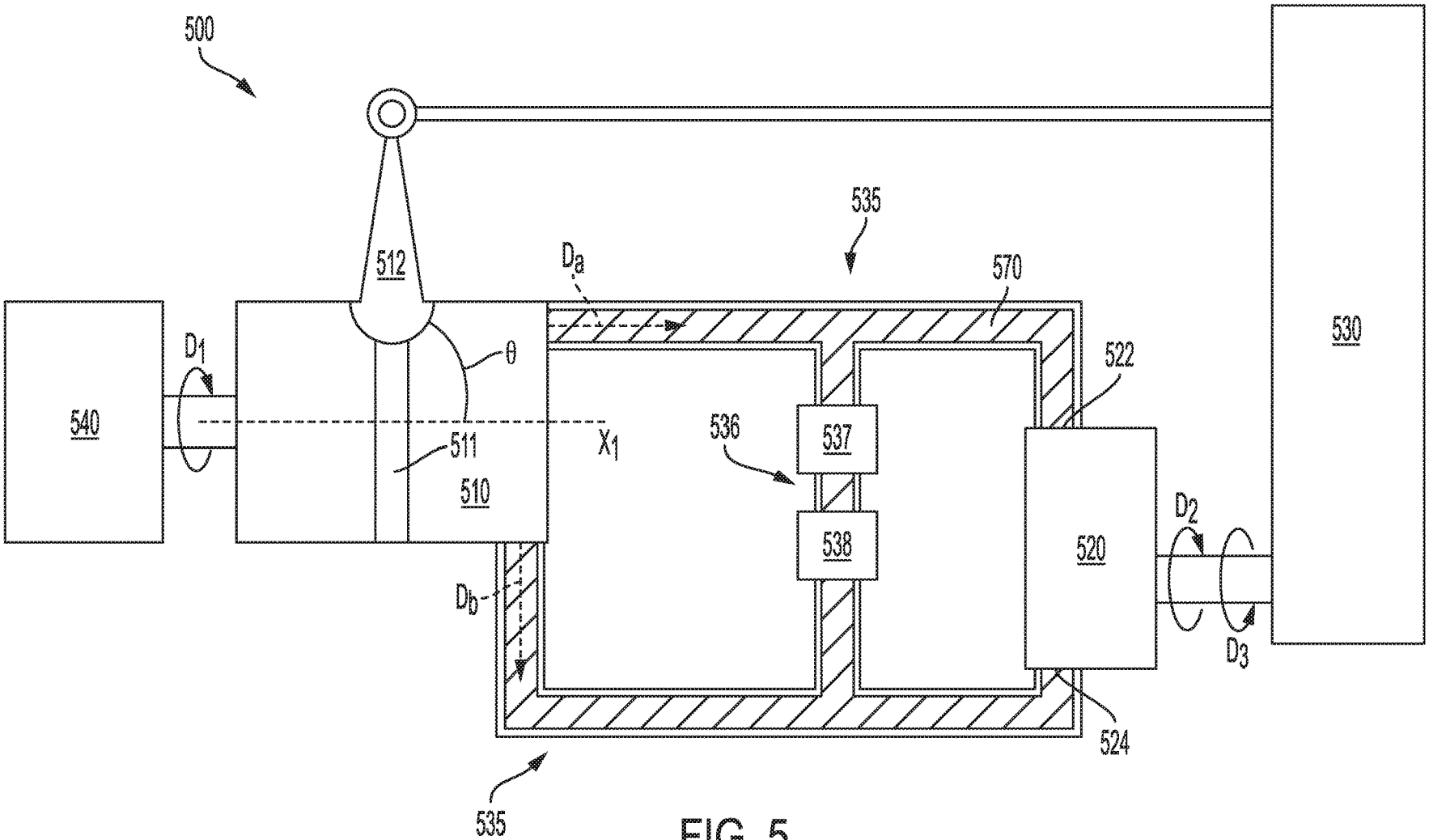
FIG. 5 is a schematic view of an aerobic apparatus according to one embodiment.

Referring to FIG. 5, a schematic view depicting an aerobic apparatus is depicted. Aerobic apparatus 500 includes variable displacement pump 510 in fluid communication with fluid motor 520 forming a fluid loop 535. Fluid motor 520 may provide mechanical energy to linkage 530. In a variation, linkage 530 is configured for communication with a user. Aerobic apparatus 500 may also include a mechanism configured to generate mechanical energy, such as motor 540 for driving pump 510. Variable displacement pump 510 may include controller 512 configured to control the rate of fluid displacement from pump 510. Apparatus 500 may further include one or more valves 537 between pump 510 and fluid motor 520. In a refinement, apparatus 500 further includes a flow controller 538 between pump 510 and fluid motor 520.

In a refinement, variable displacement pump 510 is a variable axial piston pump. The variable axial piston pump includes a swash plate 511 attached to a plurality of pistons and a barrel defining a plurality of chambers, wherein each of the pistons is at least partially disposed in one of the chambers. The barrel defines a longitudinal axis $X_1$. The swash plate 511 may form angle θ relative to the longitudinal axis $X_1$. Angle θ determines the flow rate of fluid 570 in first loop direction $D_a$. For example, in at least one embodiment, when angle θ is 90 degrees pump 510 displaces approximately no fluid, which may be referred to as the stop position. As angle θ decreases from 90 degrees to approximately 0 degrees the fluid displacement from the pump 510 increases and the flow rate of fluid 570 increases. In one or more embodiments, the swash plate 511 may not be capable of forming a 0 degrees angle. The minimum angle may vary based on the shape and size of pump 510. In a variation, the pump 510 is reversible. In at least one embodiment, reversible indicates that angle θ may be greater than 90 degrees. As angle θ increases from 90 degrees to 180 degrees the flow rate in second loop direction $D_b$ increases. In a refinement where pump 510 is a variable axial piston pump, the controller 512 may be a swash plate controller. In one variation, the controller 512 may be controlled manually by a user. For example, the user may have access to a lever attached to controller 512. In another example, the controller 512 may be controlled electronically. For example, the user may have access to controls for directing the controller 512. In still another example, a computing device may be responsible for directing the controller 512. In one variation, pump 510 is driven by motor 540. Any suitable motor may be used including but is not limited to an electric motor, a combustion motor, and a steam motor. In a refinement, motor 540 provides a rotational force $F_1$ in a first direction $D_1$ for driving pump 510.

Fluid motor 520 is in mechanical communication with linkage 530 and may provide a mechanical energy to linkage 530. In a refinement, fluid motor 520 provides rotational force $F_2$. For example, fluid motor 520 may include a rotatable component, such as a rod or gear, in mechanical communication with linkage 530, for providing rotational force $F_2$. In at least one embodiment, fluid motor 520 may be driven by first fluid flow $f_1$ from pump 510 through fluid loop 535 in first loop direction $D_a$. In a refinement, fluid motor 520 may be driven by second fluid flow $f_2$ from pump 510 through fluid loop 535 in second loop direction $D_b$. In at least one variation, fluid motor 520 defines first aperture 522 and second aperture 524. The first fluid flow $f_1$ from pump 510 entering first aperture 522 creates first fluid pressure $P_1$. Fluid motor 520 is configured to generate rotational force $F_2$ in response to fluid pressure $P_1$. Rotational force $F_2$ being in second direction $D_2$. In some variations, fluid motor 520 may be configured to receive second fluid flow $f_2$ in second aperture 524. Second fluid flow $f_2$ generates second fluid pressure $P_2$. In a refinement, pump 510 is configured to generate rotational force $F_3$ in third direction $D_3$, opposite direction $D_2$, in response to fluid pressure $P_2$. In at least one variation, rotational force $F_2$ may assist a user applying a user force $F_4$ in a direction $D_4$, when $D_2$ and $D_4$ are in the same direction. Likewise, rotational force $F_3$ may assist when $D_3$ and $D_4$ are the same direction. Thus, in embodiments configured to receive a fluid flow in either aperture, assistance may be provided in both directions. For example, in one embodiment where the linkage 530 is pedals, apparatus 500 may assist a user peddling forwards or backwards. For example, pump 510 may push fluid 570 into fluid motor 520 generating a mechanical force applied through linkage 530. In one variation, the assistive force may be used in a habilitative or rehabilitative manner. In another variation the assistive force may provide a more realistic feel. For example, if linkage 530 is pedals or resembles a stationary bike the assistive force may provide the effect of coasting. Apparatus 500 may even be used therapeutically, to ensure mobility or prevent atrophy when a user applies no force. For example, force $F_2$ may move linkage 530, in communication with a user, therefore moving the user and ensuring mobility. In one variation, the apparatus 500 may be mountable to a structure such as a bed or chair in providing rehabilitation and/or preventing atrophy. In another embodiment, apparatus 500 may be used to train muscles and provide muscle memory to a user. For example, the apparatus 500 may be configured to assist a user through a golf swing, swim stroke, pitching motion, or basketball shot.

Linkage 530 may be configured for communication with a user. Linkage 530 may be any suitable shape and size for communication with a user. For example, linkage 530 may be but is not limited to a handle, a peddle, a platform and/or a belt. In a variation, linkage 530 resembles a traditional cardio machine such as but not limited to a treadmill, a stair climber, a stationary bike, an elliptical, or a row machine. In a refinement, at least a portion of linkage 530 is configured to rotate in direction $D_4$ when a user applies user force $F_4$ in direction $D_4$. In yet another embodiment, at least a portion of linkage 530 is also configured to rotate in direction $D_5$ opposite direction $D_4$ when a user applies a user force $F_5$ in the direction $D_5$. Thus, a user may apply a force in either direction and apparatus 500 may apply an assistive force in either direction. For example, in one embodiment resembling a stationary bike, a user may pedal backwards or forwards and apparatus 500 may provide an assistive force forward or backward.

In one or more embodiment, fluid loop 535 provides fluid communication between the pump 510 and the fluid motor 520. Fluid loop 535 may be formed from any suitable material. In at least one variation, fluid loop 535 is formed from high-pressure hoses. In another variation, the fluid loop 535 may be a hard, solid tubing. In a refinement, any two components in fluid communication may also be directly connected. In a variation, fluid loop 535 includes a detour pathway 536 configured to circulate a portion of fluid 570 to and from fluid motor 520 bypassing pump 510. Thus, fluid 570 may be configured to provide resistance to a user through fluid motor 520 which is in mechanical communication with linkage 530. In a refinement, resistance may be provided when a user applies force in either direction (e.g. forwards or backwards). Resistance is produced by fluid 570, which a user must circulate to and from fluid motor 520 through detour pathway 536. In a refinement, fluid loop 535 includes one or more valves 537 for restricting a fluid flow through detour pathway 536. In still another refinement, fluid loop 535 includes a flow controller 538 for regulating the fluid flow through detour pathway 536 and thus regulating the resistance experienced by a user.

For example, in one embodiment, linkage 530 resembles a stationary bike. In at least one variation, the stationary bike includes one or more sensors to determine the force $F_4$ applied by a user peddling. In a refinement, the controller 512 is configured to move the swash plate 511 from a first position to a second position. The first position being based on user force $F_4$ and the second position being based on another user force $F_6$. In one variation, the greater the user force applied the further the associated position is from the stop position. This may be referred to as the road mode. For example, if user force $F_6$ is greater than user force $F_4$ then the second position is further from the stop position than the first position. In this variation, the apparatus 500 is configured to provide the user a more realistic feel (i.e. truer feel of the road). For example, if the user pedals hard and then stops pedaling, the fluid 570 continues to rotate. While the fluid 570 is circulating, peddling is easier. Thus, if a user stop peddling for a short duration and then begins peddling again, while fluid 570 is still circulating, the sensation of coasting is provided. In a refinement, the stationary bike includes a freewheel so the pedals do not continue to rotate when a user stops. In at least some variations, the apparatus 500 may include a resistance mode where the one or more valves 537 are configured to permit passage of the fluid 570 through the detour pathway 536 and the controller positions the swash plate 511 in the stop position. Thus, the fluid 570 provides resistance to a pedaling user as the fluid 570 circulates from the fluid motor 520, through the detour pathway 536, and back to the fluid motor 520. In a refinement, the fluid loop 535 includes a valve having an open position and a closed position. In the refinement, the resistance mode permits passage of fluid 570 when the valve is in the open position and the swash plate is in the stop position. In still a further refinement, the fluid loop 535 includes a flow controller 538. The flow controller 538 regulates the flow of fluid 570 and can be adjusted to increase or decrease the resistance. In one variation, the aerobic apparatus 500 may include a kill switch which operates as described with regards to the weight training apparatus. In this variation, the aerobic apparatus 500 engages an operational mode when the kill switch is deactivated and an inoperable mode when the kill switch is activated. The inoperable mode is configured to cut off the power to the motor 540 or fluid power to the fluid motor 520.

Figure 6:
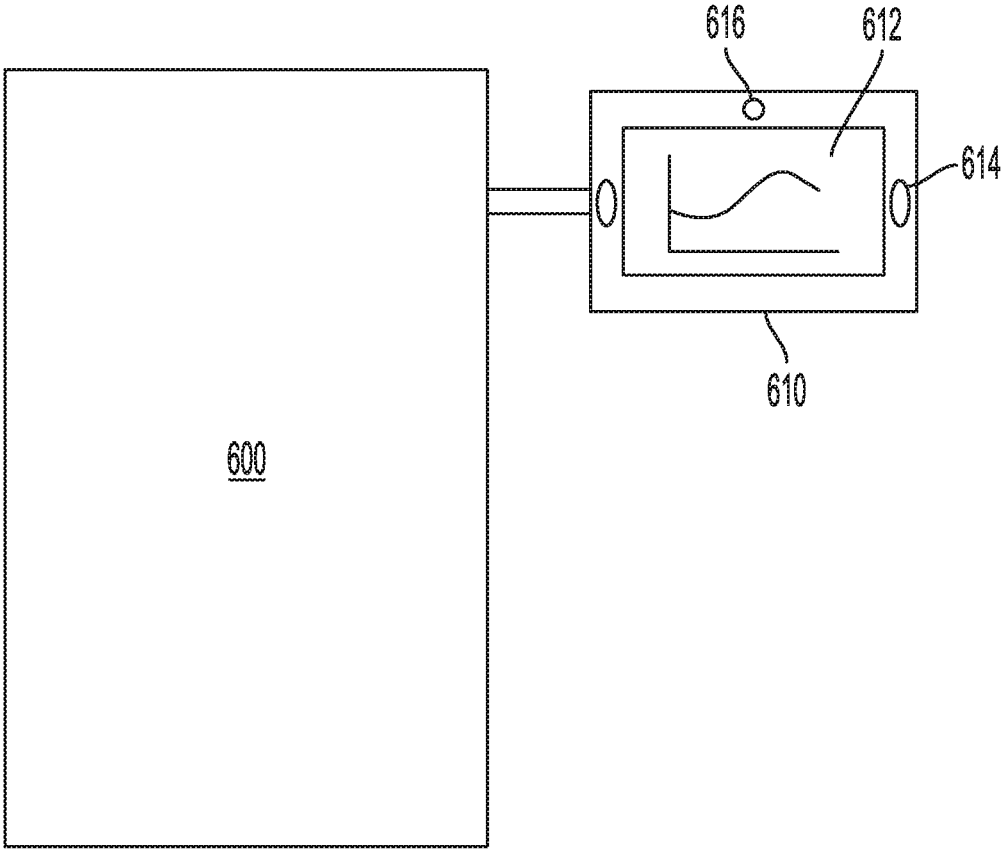
FIG. 6 is a schematic view of a dashboard according to an embodiment.

Referring to FIG. 6, an apparatus with a dashboard is provided. Apparatus 600 includes dashboard 610. In one variation, apparatus 600 include one or more sensors for collecting data such as but not limited to speed, force, weight, repetitions, sets, volume, calories, time under resistance, rest time, and/or user's physiological measurements (e.g. heart rate, pulse, oxygen levels, blood pressure). Dashboard 610 may include at least one processor including a computer having a central processing unit (CPU) for executing machine instructions and a memory for storing machine instructions that are to be executed by the CPU. In a refinement, the machine instructions include presenting the data from the one or more sensors to the user. The data may be presented by any suitable medium such as but not limited to a display 612 and/or a speaker 614. For example, when apparatus is a weight training apparatus as described herein, the display may present a graph demonstrating the force a user exerted throughout a rep, a set, or an exercise. In a refinement, the graph may report collected data such as weight or the collected data may be used to determine the approximate weight throughout the exercise. The dashboard 610 may be configured to accommodate earphones or headphones. In another refinement, the machine instructions include providing an interactive exercise. A series of interactive exercise may form a challenge. In still another refinement, the machine instructions include providing exercise instructions. A series of exercise instructions may form a routine. For example, the machine instructions may include providing an exercise or therapy routine. In yet another refinement, dashboard 610 may store data from an exercise or plurality of exercises. In the variation, the interactive exercise, challenge instructions, or routine may be adapted or responsive to the collected data. In another refinement, dashboard 610 may provide progress reports or reminders to a user. In at least one embodiment, dashboard 610, may allow a user to play media, such as a video or a song. In a refinement, the media may be downloaded or uploaded to the dashboard. In one variation, the apparatus may be controlled remotely through the dashboard. For example, in an aerobic apparatus as described herein, a therapist may direct a controller to provide therapy to a user. In a refinement, the dashboard 610 may include a camera 616 and/or a microphone for remote communication. In still another variation the dashboard 610 could be used to implement planned exercises. For example, a user may enter a time or distance and the dashboard 610 may end the exercise upon completion. The dashboard 610 may also end an exercise based on a user's physiological measurements collected from sensors. In one variation, the dashboard 610 provides a virtual trainer or coach. In another variation, the dashboard 610 may provide a virtual trip. For example, the dashboard may provide audio and video (A/V) to an aerobic apparatus resembling a stationary bike. The A/V may provide the effect of traveling on a trail through the woods. In one or more embodiments, the dashboard may allow for communication and/or sharing between multiple parties or multiple users. For example, a first user may share a routine or speak to a second user. In another variation, the dashboard 610 may provide a game or competition. For example, dashboard 610 may provide audio or video to provide a virtual race. In another embodiment, a weight training apparatus may require payment for use and report results through the dashboard 610. In a refinement, the virtual implementations may further direct the controller 512 to simulate the virtual environment. For example, an uphill environment may provide increased resistance and a downhill environment may provide assistance. In at least one embodiment, for example, the first position of a swash plate 511 may be associated with a first image on display 612 and a second position of the swash plate 511 may be associated with a second image. In yet another variation, the flow controller may be regulated to a first flow rate associated with the first image and a second flow rate associated with the second image. In still another variation, a user may share their workouts or data with other users or on social media. Dashboard 610 may use resources (e.g. processor or memory) available through a network, such as but not limited to one or more server located in another location, to perform the functions as described herein. In still another variation, the dashboard may be linked with a mobile device. In a refinement, the mobile device may be linked by a wireless communication such as but not limited to WIFI or Bluetooth. The dashboard and mobile device may communicate to perform any of the functions described herein on the mobile device. For example, the mobile device may be used to store data collected, display collected data, or provide instructions.

Figure 7:
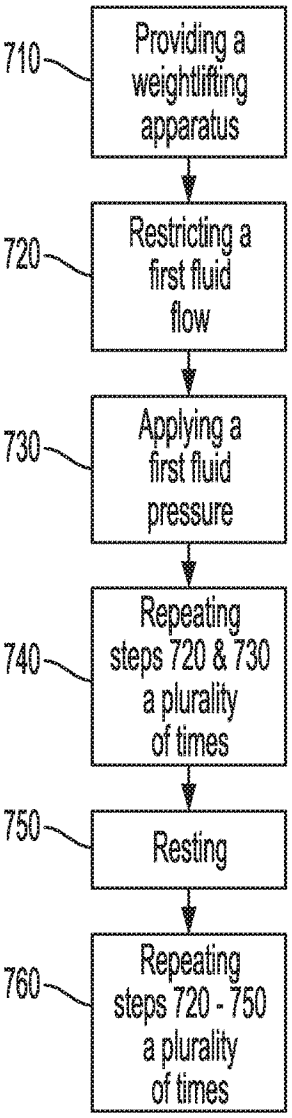
FIG. 7 is a flowchart depicting a method of weight training according to one embodiment.

Referring to FIG. 7, a flowchart for a method of weight training is provided. Step 710 includes providing a weight training apparatus as described herein. Step 720 includes restricting a first fluid flow from the internal cavity to inhibit movement of the piston in a first direction when the piston is experiencing a force from a user through the linkage to provide the user positive resistance. In a refinement, the user is a weightlifter. Step 730 includes applying a first fluid pressure to the piston surface to move the piston in a second direction. In a refinement, the piston is experiencing a force in the first direction opposite the second direction against the movement of the piston. The force is applied by a user through the linkage. In one variation, step 720 and step 730 form a repetition (a rep). Step 740 includes repeating steps 720 and 730 a plurality of times. Step 750 includes resting for a duration of time. Performing a plurality of repetitions followed by a resting period forms a set. Step 760 includes performing one or more additional sets (i.e. repeating steps 720 to 750). The number of reps and sets will depend on the particular training. For example, toning generally involves high repetition sets, strength training generally involves lower rep sets (i.e. 1-12), and hypertrophy training is in between (e.g. 6-12). In still another example, a user may perform as many repetitions as possible within a predetermined duration (i.e. a timed set). Typically, 3 to 5 sets are performed however volume training may include more sets.

Figure 8:
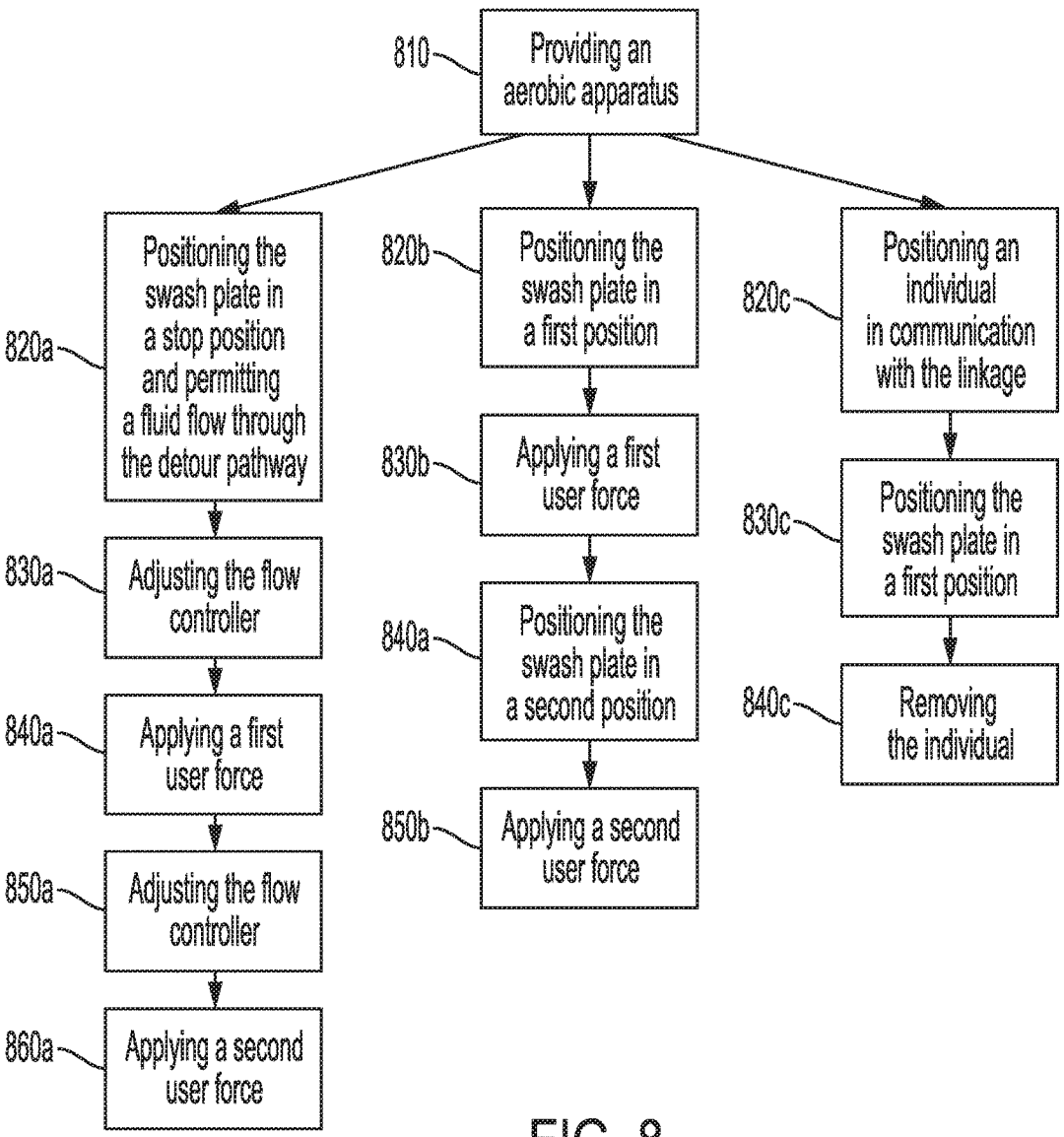
FIG. 8 is a flowchart depicting a method of aerobic exercise or providing therapy according to one embodiment.

Referring to FIG. 8, a flow chart for a method of aerobic exercise is provided. Step 810 includes providing an aerobic apparatus as described herein. In a variation, step 820*a* includes positioning the swash plate in the stop position and permitting a fluid to flow through a detour pathway. Step 830*a* includes adjusting a flow controller to achieve a desired resistance. Step 840*a* includes receiving a first user force through the linkage wherein the fluid creates resistance for the user. Step 850*a* includes adjusting the flow controller to adjust the resistance. Step 860*a* includes receiving a second user force through the linkage. In another variation, step 820*b* includes positioning the swash plate in a first position. The first position causing a first fluid flow to the fluid motor wherein the fluid motor provides a first assistive force to the linkage. Step 830*b* includes receiving a first user force through the linkage. Step 840*b* includes positioning the swash plate in a second position. The second position causing a second fluid flow to the fluid motor and providing a second assistive force to the linkage. In a refinement the second position is based on the user force. In another refinement, the first position is based on a first image presented on the dashboard and the second position is based on a second image presented on the dashboard. In another refinement, a first rate for the flow controller is associated with the first image and a second rate for the flow controller is associated with the second image. In still another variation, the first position and second position are controlled manually by an individual. For example, the user may adjust from the first position to a second position with a lever. In another example, a therapist may adjust from the first position to a second position to provide therapy. Step 850*b* includes receiving a second user force through the linkage. In yet another variation, 820*c* includes positioning an individual in communication with the linkage. Step 830*c* includes positioning the swash plate in a first position. The first position corresponds to the linkage moving at a first speed to prevent atrophy. Step 840*c* includes removing the individual from communication with linkage after a time period.

When referring to a weight training apparatus or a weight training method the description is representative or illustrative and as described herein weight or weights are not required. In fact, the embodiments described herein can operate in a zero-gravity environment and simulates weights or weight training.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A weight training apparatus comprising:

a motor configured to apply a first rotational force;

a pump including a pump inlet and a pump outlet, the pump configured to be driven by the first rotational force;

a reservoir having a reservoir inlet and a reservoir outlet, the reservoir outlet in fluid communication with the pump inlet;

a housing defining an internal cavity and having a longitudinal axis, the internal cavity configured to communicate with the pump outlet and the reservoir inlet through a fluid pathway; and a piston at least partially occupying the internal cavity and configured to move within the housing in a first direction and a second direction opposite the first direction from a first position to a second position along the longitudinal axis, the piston includes a piston shaft, a piston head and a linkage configured for communication with a user, the piston head separating a blind end of the internal cavity distal to the piston shaft and a head end of the internal cavity proximal to the piston shaft, wherein the fluid pathway is configurable to inhibit movement of the piston in the first direction along the longitudinal axis at a first fluid pressure thereby resisting movement of the linkage when a first user force is applied to the piston in the first direction through the linkage during a first positive resistance mode and the fluid pathway is configurable to apply a second fluid pressure to a first piston surface to move the piston in the second direction along the longitudinal axis thereby moving the linkage during a first negative resistance mode, the first positive resistance mode configured to reduce a first fluid flow from the pump to the blind end of the internal cavity and the first negative resistance mode configured to apply the second fluid pressure from the blind end to move the piston in the second direction.

2. The weight training apparatus of claim 1 further comprising a first switch engaging the first positive resistance mode when the piston is at the first position and engaging the first negative resistance mode when the piston is at the second position.

3. The weight training apparatus of claim 2 wherein the first switch is triggered automatically by one or more sensors detecting the first position or the second position of the piston.

4. The weight training apparatus of claim 1 further comprising one or more valves between the pump outlet, the reservoir inlet, and the internal cavity wherein a first switch is configured to control the one or more valves to engage the first negative resistance mode and the first positive resistance mode.

5. The weight training apparatus of claim 4 wherein the one or more valves include a first valve between the pump and the internal housing, and a second valve between the internal cavity and the reservoir.

6. The weight training apparatus of claim 5 wherein the first positive resistance mode includes the first valve being at least partially restricted and the second valve being at least partially open, and the first negative resistance mode includes the first valve at least partially open and the second valve being restricted.

7. The weight training apparatus of claim 1 wherein the first positive resistance mode is configured to stop the first fluid flow from the pump to the internal cavity.

8. The weight training apparatus of claim 1 further comprising a flow controller between the internal cavity and the reservoir inlet, the flow controller configured to regulate a second fluid flow from the internal cavity to the reservoir inlet thereby controlling a first speed of the piston in the first direction when the first user force is applied to the piston in the first direction through the linkage.

9. The weight training apparatus of claim 1 further comprising a kill switch wherein the kill switch engages an operative mode when activated and engages an inoperative mode when not activated, the operative mode configured to permit the first fluid flow from the pump outlet to the internal cavity and the inoperative mode configured to restrict the first fluid flow from the pump outlet to the internal cavity.

10. The weight training apparatus of claim 9 wherein the kill switch is located on the linkage.

11. The weight training apparatus of claim 10 wherein the kill switch protrudes from the linkage.

12. The weight training apparatus of claim 9 wherein the operative mode permits a maximum flow through a flow controller between the internal cavity and the reservoir inlet.

13. The weight training apparatus of claim 1 wherein the linkage is configured to form a handle to be grasped by the user.

14. The weight training apparatus of claim 1 wherein the linkage connects one or more weight training machines.

15. The weight training apparatus of claim 14 wherein the one or more weight training machines includes a chest press machine, a peck deck fly machine, a lat pulldown machine, a leg press machine, a leg extension machine, a seated curl machine, a calf raise machine, a shoulder press machine, an incline press machine, a seated row machine, a bench press machine, a power lift machine, a military press machine, an abdominal crunch machine, a high row machine, a hack squat machine, a preacher curl machine, a squat machine or any combination thereof.

16. The weight training apparatus of claim 15 wherein the one or more weight training machines includes a bench press machine, a military press machine, a squat machine, a leg press machine or any combination thereof.

17. The weight training apparatus of claim 1 wherein the first position or the second position corresponds to a start position of a weight lifting machine and the start position is adjustable by the user.

18. The weight training apparatus of claim 1 wherein the reservoir includes a fluid release and air is used as a fluid.

19. The weight training apparatus of claim 1 further comprising one or more sensors configured to collect data during an exercise and a dashboard having a non-transitory medium having computer-readable instructions stored thereon that are configured to be executed by a processor, the computer-readable instructions including communicating information and/or the data from the dashboard to the user.

20. The weight training apparatus of claim 1 wherein the linkage includes a kill switch configured to be where the user communicates with the linkage.

21. The weight training apparatus of claim 1 wherein the fluid pathway is configured to provide a range of resistance during the first positive and/or negative resistance mode during a repetition.

22. The weight training apparatus of claim 1 wherein a positive resistance and a negative resistance are not limited to a weakest point of the user during an exercise using the weight training apparatus.

23. A weight training apparatus comprising:

a motor configured to apply a first rotational force;

a pump including a pump inlet and a pump outlet, the pump configured to be driven by the first rotational force;

a reservoir having a reservoir inlet and a reservoir outlet, the reservoir outlet in fluid communication with the pump inlet;

a housing defining an internal cavity and having a longitudinal axis, the internal cavity configured to communicate with the pump outlet and the reservoir inlet through a fluid pathway; and a piston at least partially occupying the internal cavity and configured to move within the housing in a first direction and a second direction opposite the first direction from a first position to a second position along the longitudinal axis, the piston includes a piston shaft, a piston head and a linkage configured for communication with a user, the piston head separating a first end and a second end of the internal cavity, wherein the fluid pathway is configurable to inhibit movement of the piston in the first direction along the longitudinal axis at a first fluid pressure thereby resisting movement of the linkage when a first user force is applied to the piston in the first direction through the linkage during a first positive resistance mode and the fluid pathway is configurable to apply a second fluid pressure to a piston surface to move the piston in the second direction along the longitudinal axis thereby moving the linkage during a first negative resistance mode, the first positive resistance mode configured to reduce a first fluid flow from the pump to the first end of the internal cavity and the first negative resistance mode configured to apply the second fluid pressure from the first end to move the piston in the second direction.

24. The weight training apparatus of claim 23 wherein the first end of the internal cavity is a blind end of the internal cavity.

* * * * *